US011148444B2

(12) United States Patent
Ido

(10) Patent No.: US 11,148,444 B2
(45) Date of Patent: Oct. 19, 2021

(54) MEDIUM HEATING DEVICE AND PRINTING APPARATUS

(71) Applicant: SEIKO EPSON CORPORATION, Tokyo (JP)

(72) Inventor: Masahiro Ido, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/691,906

(22) Filed: Nov. 22, 2019

(65) Prior Publication Data

US 2020/0164670 A1 May 28, 2020

(30) Foreign Application Priority Data

Nov. 26, 2018 (JP) ..... JP2018-219985

(51) Int. Cl.
*B41J 29/377* (2006.01)
*B41J 2/14* (2006.01)

(52) U.S. Cl.
CPC ..... *B41J 29/377* (2013.01); *B41J 2/14088* (2013.01)

(58) Field of Classification Search
CPC ..... B41J 11/10; B41J 29/377; B41J 11/002
See application file for complete search history.

(56) References Cited

U.S. PATENT DOCUMENTS

2015/0174924 A1* 6/2015 Fuchioka ..... B41J 11/002 347/102

FOREIGN PATENT DOCUMENTS

JP 2013-018150 1/2013

* cited by examiner

*Primary Examiner* — Lam S Nguyen
(74) *Attorney, Agent, or Firm* — Workman Nydegger

(57) ABSTRACT

A medium heating device includes a heating unit configured to heat a medium; a first control unit and a second control unit configured to control the heating unit; and a housing including the first control unit and the second control unit inside the housing. Each of the first control unit and the second control unit includes an air inlet and an air outlet. The first control unit and the second control unit include an air intake and exhaust fan installed at at least one of the air inlet and the air outlet of the first control unit, and at at least one of the air inlet and the air outlet of the second control unit. The first control unit and the second control unit are disposed such that the air outlet of the first control unit and the air outlet of the second control unit face each other.

7 Claims, 7 Drawing Sheets

MEDIUM HEATING DEVICE AND PRINTING APPARATUS

The present application is based on, and claims priority from JP Application Serial Number 2018-219985, filed Nov. 26, 2018, the disclosure of which is hereby incorporated by reference herein in its entirety.

BACKGROUND

1. Technical Field

The present disclosure relates to a medium heating device for heating a medium, and a printing apparatus including the medium heating device.

2. Related Art

In the related art, printing apparatuses that perform printing on a medium such as roll paper are known. The printing apparatus typically includes a discharge head that discharges ink, and a carriage that holds the discharge head and moves back and forth in the scanning direction orthogonal to the transport direction of the medium. The printing apparatus performs printing by discharging ink from the discharging head toward the medium while moving the carriage in the scanning direction. Note that in the case where an ink (fluid) that requires penetration drying or evaporation drying is used in such a printing apparatus, it is necessary to install a medium heating device including a heating unit such as a heater in order to dry and fix the ink discharged onto the medium.

J-P-A-2013-18150 discloses a recording apparatus (printing apparatus) in which a control unit that controls a heater is provided inside a box-shaped part constituting a heating unit, an air intake and exhaust unit cools the control unit by gas introduced into the box-shaped part, and a gas warmed by taking away the heat of the control unit is exhausted.

In the recording device of J-P-A-2013-18150, one heater control board is used as the control unit that controls the heater, and the heater control board is cooled by exhausting warmed air to the outside by the air intake and exhaust unit as described above. However, in the case where a plurality of heater control boards are used, it is necessary to cool each of the heater control boards. In the case where the heater control boards disposed side-by-side inside the box-shaped part are sequentially cooled, air warmed through cooling of the first heater control board is used for cooling the next heater control board, and consequently a sufficient cooling effect may not be achieved.

SUMMARY

A medium heating device of the present application includes a heating unit configured to heat a medium, a first control unit and a second control unit configured to control the heating unit, and a housing including the first control unit and the second control unit inside the housing. Each of the first control unit and the second control unit includes an air inlet and an air outlet, the first control unit and the second control unit include an air intake and exhaust fan installed at at least one of the air inlet and the air outlet of the first control unit, and at at least one of the air inlet and the air outlet of the second control unit, and the first control unit and the second control unit are disposed such that the air outlet of the first control unit and the air outlet of the second control unit face each other.

In the medium heating device, preferably, a partition plate is provided such that the air inlet and the air outlet do not communicate with each other inside the housing.

In the medium heating device, preferably, the first control unit and the second control unit include an airflow guiding part configured to guide exhaust from the air outlets that face each other.

Preferably, the medium heating further includes a third control unit including an air inlet and an air outlet, the third control unit being configured to control the heating unit. The air outlet of the first control unit and the air outlet of the second control unit face each other, and the air inlet of the second control unit and the air inlet of the third control unit face each other.

In the medium heating device, preferably, the housing includes an opening located on an upper side of the first control unit and the second control unit, the opening being configured to communicate with outside along a direction in which the first control unit and the second control unit are disposed, and the first control unit and the second control unit include the air inlet and the air outlet on the opening side.

In the medium heating device, preferably, the first control unit and the second control unit include a heat sink for heat dissipation, the heat sink includes a plurality of fins, and the plurality of fins are formed along a flow of air flowing from the air inlet to the air outlet.

A printing apparatus of the present application includes any of the above-mentioned medium heating devices.

DESCRIPTION OF EXEMPLARY EMBODIMENTS

Figure 1:
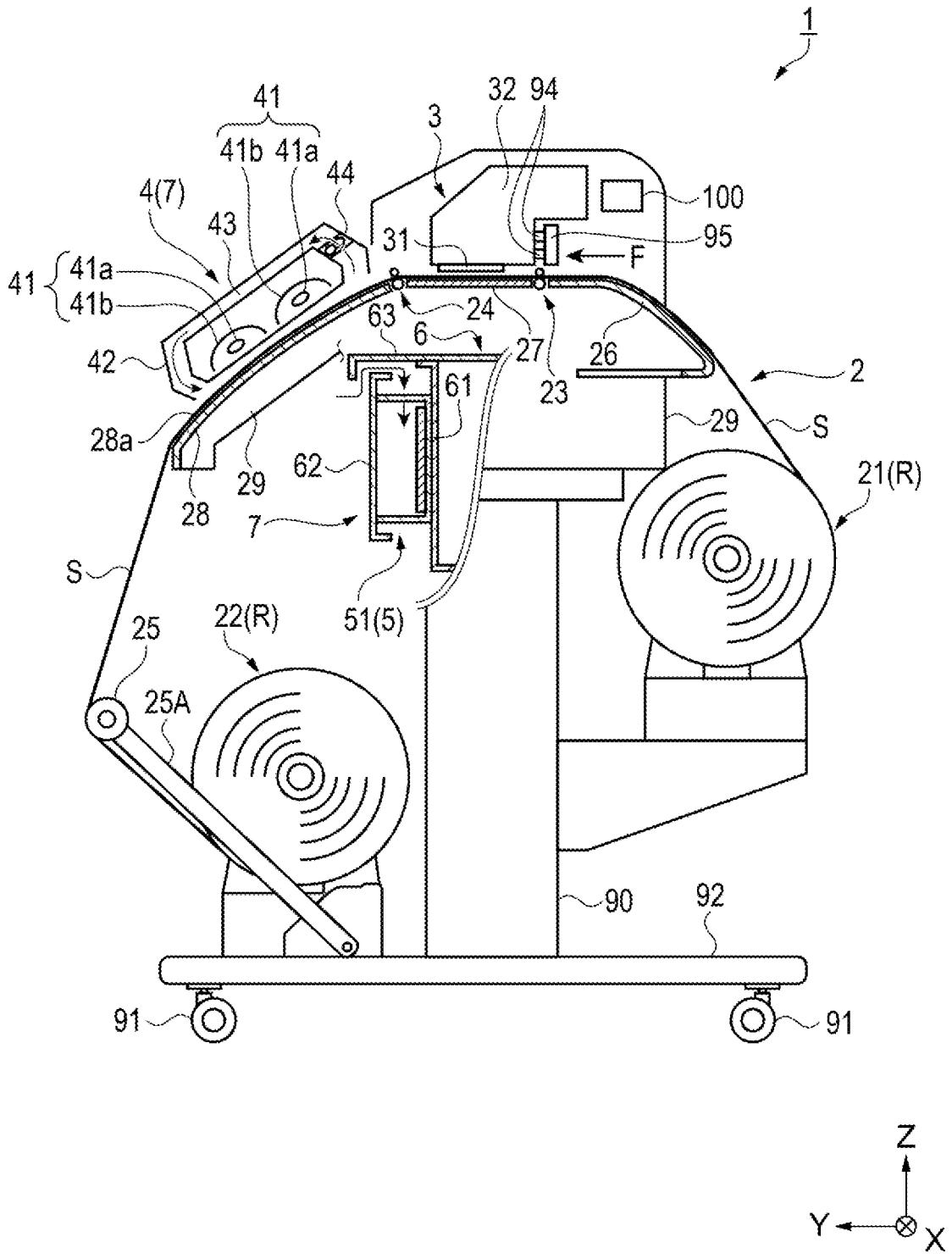
FIG. 1 is a schematic view illustrating a configuration of a printing apparatus according to a first embodiment.

Embodiments of the present disclosure are described below with reference to the accompanying drawings. Note that, for clarity of illustration, elements illustrated in the drawings are not necessarily be drawn to scale.

First Embodiment

FIG. 1 is a schematic view illustrating a configuration of a printing apparatus 1 according to a first embodiment of the present disclosure.

As illustrated in FIG. 1, a large format printer (LFP) that handles a long sheet S as an exemplary medium is described as the printing apparatus 1 of the embodiment.

The drawings, including FIG. 1, are illustrated using a XYZ coordinate system. The Z direction is a direction along the gravitational direction and the vertical direction. Hereinafter, the Z direction is also referred to as a vertical direction Z or a height direction Z. The X direction intersects (in the present embodiment, is orthogonal to) the vertical direction Z and is a scanning direction of a carriage 32. Hereinafter, the X direction is also referred to as a width direction X or a scanning direction X. The Y direction is a direction that intersects (in the present embodiment, is orthogonal to) both the vertical direction Z and the width direction X. Hereinafter, the Y direction is also referred to as a front-back direction Y.

In the front-back direction Y, the apparatus front side (front direction) or the apparatus forward side (forward direction) of the printing apparatus 1 is set as the +Y direction, and the apparatus back side (back direction) or the apparatus rear side (rearward direction) is set as the −Y direction. In the width direction X, the apparatus left side (left direction) is set as the +X direction, and the apparatus right side (right direction) is set as the −X direction when the printing apparatus 1 is viewed from the front side. In the vertical direction Z, the apparatus upper side (upward direction) is set as the +Z direction, and the apparatus lower side (lower direction) is set as the −Z direction.

As illustrated in FIG. 1, the printing apparatus 1 includes a transporting unit 2 that transports a sheet S in a roll-to-roll manner, a printing unit 3 that prints images, letters, or the like by discharging ink (fluid) onto the sheet S, and a heating unit 4 that heats the sheet S. The above-mentioned components are supported by a body frame 90. In addition, the body frame 90 is supported by a pair of legs 92 provided with a wheel 91 attached at the lower end. In addition, the printing apparatus 1 includes a control unit 100 that comprehensively controls the members.

The transporting unit 2 includes a feeding roll 21 that feeds a rolled sheet S from a roll body R in a transport direction F, and a winding roll 22 that winds the fed sheet S on the roll body R. The transporting unit 2 includes a first transport roller pair 23 and a second transport roller pair 24 that transport the sheet S in the transport path between the feeding roll 21 and the winding roll 22. In addition, the transport unit 2 includes a tension roller 25 that applies tension to the sheet S in the transport path between the second transport roller pair 24 and the winding roll 22.

The tension roller 25 is supported by a rocking frame 25A, and is configured to make contact with the rear surface of the sheet S in the width direction X. The tension roller 25 is formed so as to be longer than the width of the sheet S in the width direction X. In the transport direction F, the tension roller 25 is provided downstream of the heating unit 4 described later.

The transport unit 2 includes a first support member 26, a second support member 27, and a third support member 28 that transport the sheet S fed from the feeding roll 21 in the transport direction F by supporting the sheet S, and constitute a transport path. The first support member 26 is a support member having a flat plate shape with a support surface. The first support member 26 brings the sheet S to the first transport roller pair 23 from the upstream side in the transport direction F. The second support member 27 is a support member installed opposite the discharge head 31 of the printing unit 3. The second support member 27 has a flat plate shape with a support surface and brings the sheet S to the second transport roller pair 24 from the first transport roller pair 23. The second support member 27 functions as a so-called platen.

The third support member 28 is a support member having a flat plate shape with a support surface 28*a*. The third support member 28 supports the sheet S such that the sheet S is curved upward, and supports the sheet S from the second transport roller pair 24 to approximately half of the path between the second transport roller pair 24 and the tension roller 25.

Note that, in the width direction X, the first support member 26, the second support member 27, and the third support member 28 are formed so as to be longer than the width of the sheet S. The first support member 26, the second support member 27, and the third support member 28 are fixed to a support part 29 in a detachable manner. The first support member 26, the second support member 27, and the third support member 28 are fixed to the body frame 90 with the support part 29 therebetween.

The printing unit 3 includes a discharge head 31 as an ink jet head that discharges ink onto the sheet S in the transport path between the first transport roller pair 23 and the second transport roller pair 24, and the carriage 32 that can move back and forth in the width direction X with the discharge head 31 mounted therein. The discharge head 31 includes a plurality of nozzles (not illustrated), and can discharge ink that is selected in accordance with the material of the sheet S and requires penetration drying and evaporation drying. The carriage 32 is supported on two carriage shafts 94 provided so as to extend in the width direction X such that the carriage 32 can move back and forth. The two carriage shafts 94 are supported by a carriage frame 95.

The heating unit 4 of the present embodiment constitutes a medium heating device 7. Note that the medium heating device 7 of the present embodiment is composed of the heating unit 4, a heater control unit 5, and a control unit fixing housing 6, which are described later.

The heating unit 4 is configured to rapidly dry and fix the ink to the sheet S by heating the sheet S so as to prevent bleeding and blurring, thereby increasing the image quality. The heating unit 4 heats the printed sheet S at a position downstream of the position where the printing unit 3 is provided in the transport direction F. Specifically, the heating unit 4 is disposed on the upper side (+Z side) of the third support member 28 so as to face the sheet S that is being supported and transported on the support surface 28*a* of the third support member 28. The heating unit 4 dries the ink by heating the sheet S from the front side, which is the printing surface side, of the sheet S.

Now a configuration of the heating unit 4 is described.

The heating unit 4 includes two infrared heaters 41, a heating housing 42, a duct 43, a suction fan 44, and the like. The two infrared heaters 41 of the heating unit 4 are controlled by a first control unit 51 serving as a first control unit and a second control unit 52 (see FIG. 2) serving as a second control unit, which constitute the heater control unit 5 described later.

The infrared heater 41 includes an infrared irradiation unit 41*a*, a reflection plate 41*b*, and the like. The infrared heater 41 is disposed to irradiate the sheet S that is being transported on the support surface 28*a* not only with direct light from the infrared irradiation unit 41*a* but also with light reflected by the reflection plate 41*b*. In the present embodiment, the infrared heater 41 performs irradiation with infrared rays as electromagnetic waves.

The heating housing 42 is a box-shaped cover that supports the infrared heater 41 therein, and is provided so as to cover the infrared heater 41. The heating housing 42 is disposed so as to cover the sheet S on the support surface 28*a* in the drying region for drying the sheet S. The duct 43 is formed inside the heating housing 42, and the suction fan 44 and the like are provided in the duct 43.

The suction fan 44 sucks evaporative gas (or water vapor in the case of aqueous ink) that is generated when the sheet S on the support surface 28*a* is heat-dried. Then, the evaporative gas sucked in the suction fan 44 is liquefied (or dehumidified through collection of moisture in the case of aqueous ink) in the duct 43, and gas (gas having been subjected to liquefaction of evaporative gas) is sent from the ejection port (on the side opposite to the side on which the suction fan 44 is attached) of the duct 43. The gas thus sent is directed toward the sheet S on the support surface 28*a*. This directed gas also facilitates the drying of the sheet S.

Figure 2:
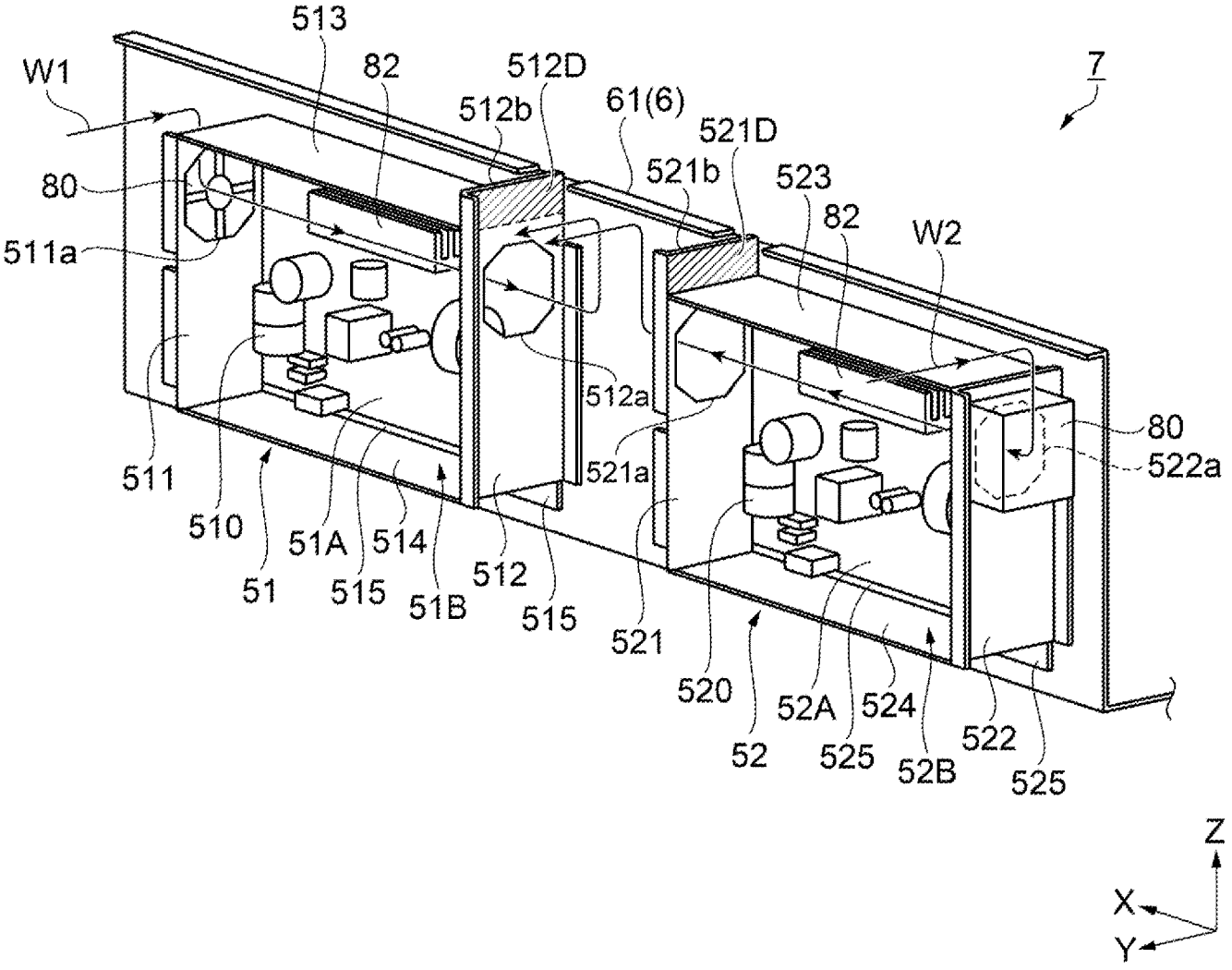
FIG. 2 is a schematic perspective view illustrating a heater control unit.

FIG. 2 is a schematic perspective view illustrating the heater control unit 5. FIG. 2 illustrates a state where a front face cover 62 and a top cover 63 of the control unit fixing housing 6 are removed to illustrate a configuration of the heater control unit 5. In addition, FIG. 2 is a perspective view of the heater control unit 5 as viewed from the upper side on the right side of the front face.

Figure 3:
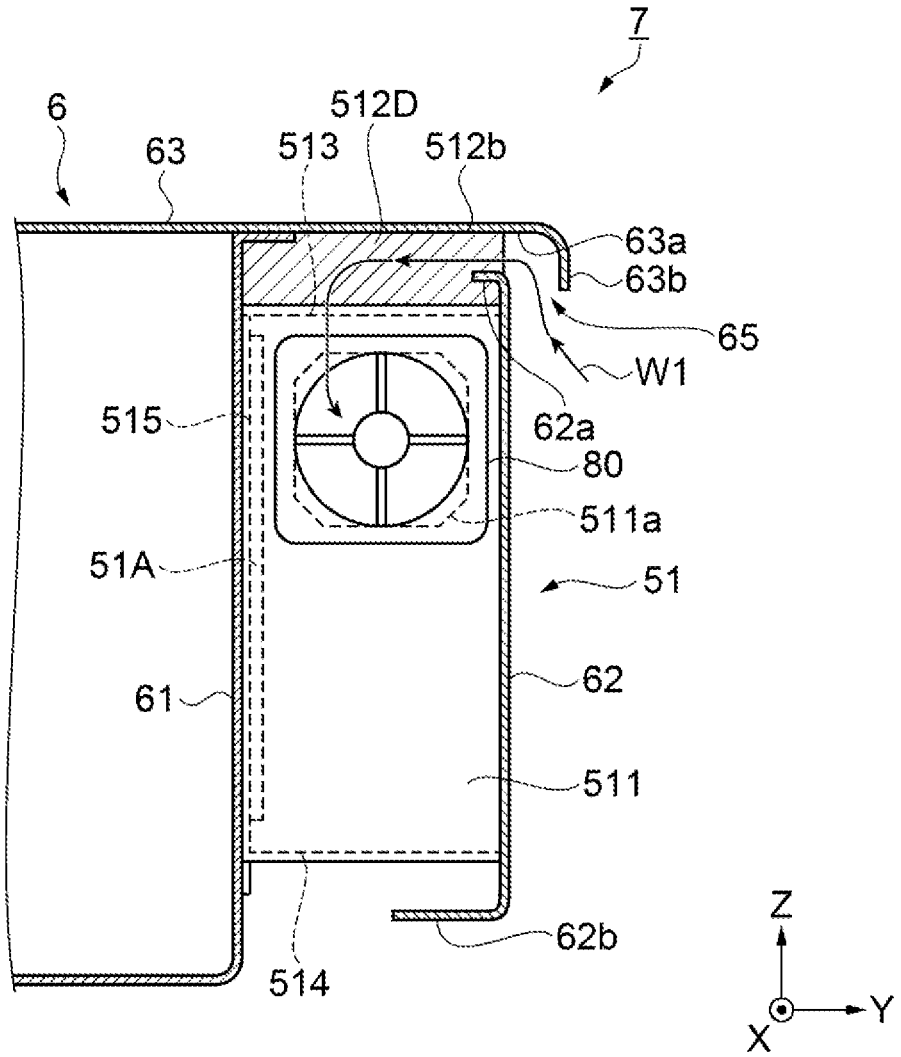
FIG. 3 is a side view of a first control unit as viewed from the left side.
Figure 4:
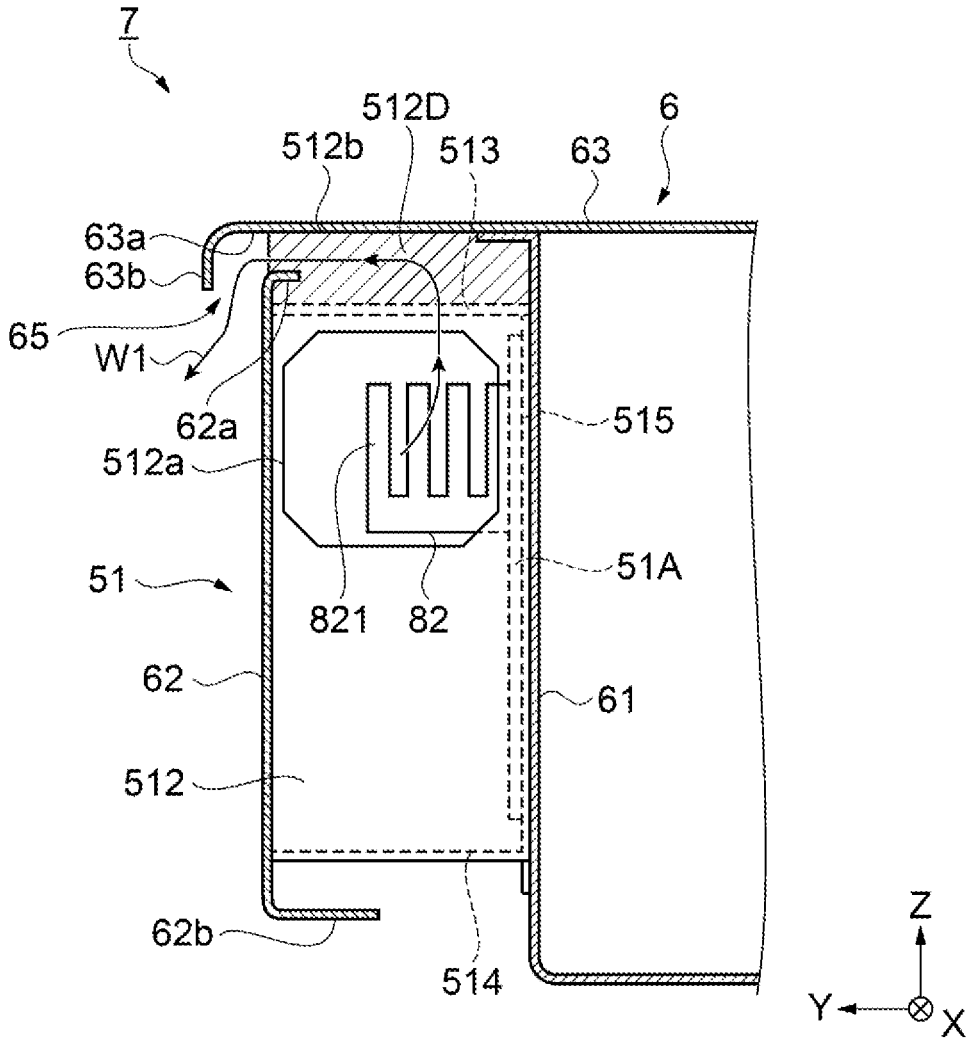
FIG. 4 is a side view of the first control unit as viewed from the right side.

FIG. 3 is a side view of the left side of the first control unit 51. Specifically, FIG. 3 is a side view of the first control unit 51 as viewed from the +X direction (left side) to the −X direction (right side) in the width direction X. FIG. 4 is a side view of the right side of the first control unit 51. Specifically, FIG. 4 is a side view of the first control unit 51 as viewed from the −X direction (right side) to the +X direction (left side) in the width direction X.

The heater control unit 5 of the present embodiment constitutes the medium heating device 7. The heater control unit 5 is composed of two control units, the first control unit 51 and the second control unit 52. Note that the two control units respectively control the two infrared heaters 41 of the heating unit 4.

Now a configuration of the first control unit 51 is described.

As illustrated in FIGS. 2 to 4, the first control unit 51 includes a first board 51A on which circuit elements 510 are mounted on a circuit wiring board, and a first housing 51B that houses the first board 51A therein.

The first housing 51B is configured in a box shape. The first housing 51B is composed of a left face cover 511, a right face cover 512, an upper face cover 513, a lower face cover 514, and a rear face cover 515. As faces of five orientations, the left face cover 511, the right face cover 512, the upper face cover 513, the lower face cover 514, and the rear face cover 515, each of which is formed by bending a plate-like metal member, are assembled together in a box shape. The first board 51A is fixed to the inner surface of the rear face cover 515.

In the first housing 51B, the rear face cover 515 is fixed to the front face side of a base frame 61 of the control unit fixing housing 6, and thus the first control unit 51 is fixed to the base frame 61. As illustrated in FIGS. 3 and 4, the front face side of the first housing 51B is covered with the front face cover 62 of the control unit fixing housing 6. With this configuration, the first board 51A is closed in the six directions.

Note that, as illustrated in FIGS. 2 and 3, an air inlet 511*a* as an octagonal opening is formed in an upper portion in the left face cover 511. An air intake fan 80 is installed on the outer surface of the left face cover 511 so as to cover the air inlet 511*a*. In the present embodiment, a so-called axial fan is used as the air intake fan 80. Note that the axial fan has a structure that discharges, in a rotational axis direction, air taken in the rotational axis direction.

In addition, as illustrated in FIGS. 2 and 4, an air outlet 512*a* as an octagonal opening is formed in an upper portion in the right face cover 512. In the present embodiment, when the first housing 51B is assembled, the air inlet 511*a* and the air outlet 512*a* are located opposite each other.

The right face cover 512 is configured such that an upper end portion 512*b* extends upward of the upper face cover 513. As illustrated in FIGS. 3 and 4, when the top cover 63 of the control unit fixing housing 6 is fixed to the base frame 61 so as to cover the base frame 61 from the upper side, the upper side of the first control unit 51 is also covered, and the end portion 512*b* substantially makes contact with a rear surface 63*a* of the top cover 63. Note that, as indicated with the hatching in FIGS. 2, 3, and 4, in the right face cover 512, a region extending upward from the upper face cover 513 to the end portion 512*b* is defined as a partition region 512D in the present embodiment. The partition region 512D is described later.

As illustrated in FIG. 4, the first board 51A includes a heat sink 82 for heat dissipation. In addition, the heat sink 82 includes a plurality of fins 821. As illustrated in FIGS. 2 and 4, in the first housing 51B, the heat sink 82 is installed so as to be located between the air inlet 511*a* and the air outlet 512*a*, which are located substantially opposite each other.

The plurality of fins 821 are disposed along a flow of air W1 flowing from the air inlet 511*a* to the air outlet 512*a*. Specifically, the fins 821 are disposed such that the direction along the side having a larger surface area is substantially aligned with the flow direction of the air W1 flowing from the air inlet 511*a* to the air outlet 512*a*.

Next, a configuration of the second control unit 52 is described.

As illustrated in FIG. 2, the second control unit 52 has a configuration substantially similar to that of the first control unit 51. The second control unit 52 is composed of a second board 52A on which circuit elements 520 are mounted on a circuit wiring board and a second housing 52B that houses the second board 52A therein.

The second housing 52B has a box shape substantially similar to the first housing 51B. The second housing 52B is composed of a left face cover 521, a right face cover 522, an upper face cover 523, a lower face cover 524, and a rear face cover 525. As faces of five orientations, the left face cover 521, the right face cover 522, the upper face cover 523, the lower face cover 524, and the rear face cover 525, each of which is formed by bending a plate-like metal member, are assembled together in a box shape. The second board 52A is fixed to the inner surface of the rear face cover 525.

The second housing 52B is disposed on the right side (−X side) of the first housing 51B and is fixed to the front face side of the base frame 61, and thus the second control unit 52 is fixed to the base frame 61. As with the first housing 51B, the front face side of the second housing 52B is covered with the front face cover 62 of the control unit fixing housing 6. With this configuration, the second board 52A is closed in the six directions.

Note that, as illustrated in FIG. 2, an air inlet 522*a* as an octagonal opening is formed in an upper portion in the right face cover 522 as with the left face cover 511 of the first housing 51B. The air intake fan 80 is installed on the outer surface of the right face cover 522 so as to cover the air inlet 522*a*.

In addition, as illustrated in FIG. 2, an air outlet 521*a* as an octagonal opening is formed in an upper portion in the left face cover 521 as with the right face cover 512 of the first housing 51B. In the present embodiment, when the second housing 52B is assembled, the air inlet 522*a* and the air outlet 521*a* are located opposite each other.

The left face cover 521 is configured such that an upper end portion 521*b* extends upward of the upper face cover 523. As with the end portion 512*b*, the end portion 521*b* substantially makes contact with the rear surface 63*a* of the top cover 63 when the top cover 63 is fixed to the base frame 61 so as to cover the base frame 61 from the upper side. Note that, as indicated with the hatching in FIG. 2, in the left face cover 521, a region extending upward from the upper face cover 523 to the end portion 521*b* is defined as a partition region 521D in the present embodiment. The partition region 521D is described later.

As with the first board 51A, the second board 52A includes the heat sink 82 for heat dissipation. In addition, the heat sink 82 includes a plurality of fins 821. In the second housing 52B, the heat sink 82 is installed so as to be located between the air inlet 522*a* and the air outlet 521*a*, which are located substantially opposite each other.

The plurality of fins 821 are disposed along a flow of air W2 flowing from the air inlet 522*a* to the air outlet 521*a*. Specifically, the fins 821 are disposed such that the direction along the side having a larger surface area is substantially aligned with the flow direction of the air W2 flowing from the air inlet 522*a* to the air outlet 521*a*.

The control unit fixing housing 6 of the present embodiment constitutes the medium heating device 7. The control unit fixing housing 6 is fixed to the body frame 90, and includes the base frame 61, the front face cover 62, and the top cover 63. The base frame 61 is formed in a U-cross sectional shape so as to open in the upper direction and to extend in the width direction X. The front face cover 62 is formed so as to extend in the width direction X and to constitute the front face side of the first housing 51B and the second housing 52B. The top cover 63 is formed so as to extend in the width direction X and to cover the base frame 61 from the upper side. Each of the base frame 61, the front face cover 62, and the top cover 63 is formed by bending a plate-like metal member.

The front face cover 62 is fixed to the front-end portions of the left face cover 511 and the right face cover 512 of the first housing 51B. The front face cover 62 is also fixed to the front-end portions of the left face cover 521 and the right face cover 522 of the second housing 52B. As illustrated in FIGS. 3 and 4, when the front face cover 62 is fixed, a bent upper end portion 62*a* of the front face cover 62 and a bent lower end portion 62*b* are oriented toward the inner side of the printing apparatus 1.

In addition, as illustrated in FIGS. 3 and 4, when the top cover 63 is fixed to the base frame 61 so as to cover the base frame 61 from the upper side, the top cover 63 covers the upper side of the first control unit 51 and the second control unit 52 while extending frontward such that a gap is provided between it and the upper end portion 62*a* of the front face cover 62 with a lower end portion 63*b* oriented toward the lower side.

The control unit fixing housing 6 configured in the above-mentioned manner functions as a housing that houses the first control unit 51 and the second control unit 52 therein.

As described above, the gap formed between the vicinity of the upper end portion 62*a* of the front face cover 62 and the lower end portion 63*b* of the top cover 63, or the gap formed between the vicinity of the upper end portion 62*a* of the front face cover 62 and the rear surface 63*a* of the top cover 63 is formed along the width direction X, which is the direction in which the front face cover 62 and the top cover 63 extend. In other words, the gap is formed along the width direction X, which is the direction in which the first control unit 51 and the second control unit 52 are disposed. This gap is referred to as an opening 65 in the present embodiment.

The opening 65 is located on the upper side of the first control unit 51 and the second control unit 52. The opening 65 communicates between the interior of the control unit fixing housing 6 and the outside (the outside of the printing apparatus 1). With the above-mentioned configurations of the control unit fixing housing 6 and the heater control unit 5, the first control unit 51 and the second control unit 52 have a configuration in which the air inlets 511*a* and 522*a* and the air outlets 512*a* and 521*a* are provided on the opening 65 side.

As illustrated in FIG. 2, the first control unit 51 and the second control unit 52 disposed on the right side (−X side) of the first control unit 51 of the present embodiment are fixed to the base frame 61, and the air outlet 512*a* of the first control unit 51 and the air outlet 521*a* of the second control unit 52 are disposed so as to face each other.

Here, when the air intake fan 80 of the first control unit 51 is driven, the air W1 outside the printing apparatus 1 flows into the interior of the control unit fixing housing 6 serving as a housing from the gap serving as the opening 65 between the upper end portion 62*a* of the front face cover 62 and the end portion 63*b* of the top cover 63 as indicated by the arrows in FIGS. 2 and 3. Specifically, the air W1 enters from a region of the opening 65 near the air inlet 511*a*. Then, the entered air W1 is taken by the air intake fan 80 of the first control unit 51, and flows into the interior of the first housing 51B through the air inlet 511*a*.

The air W1 having entered the interior of the first housing 51B takes away the heat in the housing warmed by the operation of the first board 51A and flows along the surfaces of the plurality of fins 821 of the heat sink 82, thereby taking away the heat from the fins 821 while flowing toward the air outlet 512*a*. Then, the air W1 warmed by taking away the heat is exhausted to the outside of the first housing 51B through the air outlet 512*a* as indicated by the arrows in FIGS. 2 and 4. In the present embodiment, the air is exhausted from the air outlet 512*a* in the right direction, which is the −X direction.

When the air intake fan 80 of the second control unit 52 is driven, the air W2 outside the printing apparatus 1 flows into the interior of the control unit fixing housing 6 as a housing from the gap serving as the opening 65 between the upper end portion 62*a* of the front face cover 62 and the end portion 63*b* of the top cover 63 as indicated by the arrows in FIG. 2 as with the operation of the air intake fan 80 of the first control unit 51. Specifically, the air W2 enters from the region of the opening 65 near the air inlet 522*a*. Then, the entered air W2 is taken by the air intake fan 80 of the second control unit 52, and flows into the interior of the second housing 52B through the air inlet 522*a*.

The air W2 having entered the interior of the second housing 52B takes away the heat in the housing warmed by the operation of the second board 52A and flows along the surfaces of the plurality of fins 821 of the heat sink 82, thereby taking away the heat from the fins 821 while flowing toward the air outlet 521*a*. Then, the air W2 warmed by taking away the heat is exhausted to the outside of the second housing 52B through the air outlet 521*a*. In this case, the air W2 is exhausted from the air outlet 521*a* in the left direction, which is the +X direction.

As indicated by the arrows in FIG. 2, the air W1 exhausted in the right direction, which is the −X direction, from the air outlet 512*a* of the first housing 51B, and the air W2 exhausted in the left direction, which is the +X direction, from the air outlet 521*a* of the second housing 52B collide with each other. As illustrated by the arrows in FIG. 2, the collided airs W1 and W2 flow to the opening 65 located in the vicinity of the air outlets 512*a* and 521*a*, and are exhausted from the opening 65 to the outside of the printing apparatus 1, which is the outside of the control unit fixing housing 6. Through this operation, the first board 51A and the second board 52A in the first control unit 51 and the second control unit 52 are cooled to an appropriate temperature.

Here, as described above, the air outlets 512*a* and 521*a* are provided in upper portions in the first housing 51B and the second housing 52B. In other words, the air outlets 512*a* and 521*a* are provided near the opening 65. As a result, with the collision between the air W1 and the air W2, combined with the increase in the inner pressure resulting from the collision, the air W1 and the air W2 easily flow to the opening 65 side that is open toward the outside of the printing apparatus 1, and the air W1 and the air W2 are exhausted from the opening 65.

In addition, in the present embodiment, the internal space (in particular, the opening 65) of the control unit fixing housing 6 formed along the X direction is partitioned by the partition region 512D provided in the right face cover 512 of the first control unit 51 and the partition region 521D provided in the left face cover 521 of the second control unit 52. In other words, the partition region 512D partitions the space such that the air inlet 511*a* and the air outlet 512*a* do not communicate with each other at the opening 65. In addition, the partition region 521D partitions the space such that the air inlet 522*a* and the air outlet 521*a* do not communicate with each other at the opening 65. In the present embodiment, the right face cover 512 including the partition region 512D and the left face cover 521 including the partition region 521D function as partition plates.

With the right face cover 512 and the left face cover 521 serving as partition plates, the airs W1 and W2 exhausted from the air outlets 512*a* and 521*a* are exhausted to the outside from the opening 65 partitioned off by the right face cover 512 and the left face cover 521 while colliding with each other. With the right face cover 512 and the left face cover 521 serving as the partition plates, the airs W1 and W2 exhausted from the opening 65 to the outside are prevented from being again taken in from the air inlets 511*a* and 522*a* as much as possible.

The medium heating device 7 of the printing apparatus 1 according to the present embodiment can provide the following effects.

According to the medium heating device 7 of the present embodiment, the first control unit 51 and the second control unit 52 that control the heating unit 4 are disposed such that the air outlets 512*a* and 521*a* thereof face each other, and that the airs W1 and W2 exhausted from the air outlets 512*a* and 521*a* collide with each other. In this manner, it is possible to prevent their exhausts from affecting each other's cooling efficiencies. Thus, the first control unit 51 and the second control unit 52 can be efficiently cooled.

Note that, for example, in the case where the air outlet of the first control unit and the air inlet of the second control unit are disposed so as to face each other, warmed air exhausted from the air outlet of the first control unit is taken in from the air inlet of the second control unit, and consequently the cooling efficiency of the second control unit is reduced. In view of such a failure, the medium heating device 7 of the present embodiment can efficiently cool the first control unit 51 and the second control unit 52.

According to the medium heating device 7 of the present embodiment, the right face cover 512 serving as a partition plate is provided such that the air inlet 511*a* and the air outlet 512*a* of the first housing 51B do not communicate with each other through the opening 65 inside the control unit fixing housing 6. As a result, the cooling air W1 taken in from the air inlet 511*a* and the warmed air W1 exhausted from the air outlet 512*a* can be separated from each other, and thus the taken air W1 and the exhaust air W1 can be prevented from being mixed together, and in this manner, the first control unit 51 can be efficiently cooled. In addition, the left face cover 521 serving as a partition plate is provided such that the air inlet 522*a* and the air outlet 521*a* of the second housing 52B do not communicate with each other through the opening 65 inside the control unit fixing housing 6. As a result, the cooling air W2 taken in from the air inlet 522*a* and the warmed air W2 exhausted from the air outlet 521*a* can be separated from each other, and thus the taken air W2 and the exhaust air W2 can be prevented from being mixed together, and in this manner, the second control unit 52 can be efficiently cooled.

According to the medium heating device 7 of the present embodiment, the airs W1 and W2 warmed inside the first control unit 51 and the second control unit 52 are easily moved in the upper direction inside the first housing 51B and the second housing 52B. At this time, the opening 65 provided in the control unit fixing housing 6 on the upper side of the first control unit 51 and the second control unit 52 communicates with the outside of the printing apparatus 1 along the width direction X, which is the direction in which the first control unit 51 and the second control unit 52 are disposed. Further, with the air inlets 511*a* and 522*a* and the air outlets 512*a* and 521*a* of the first control unit 51 and the second control unit 52 provided on the opening 65 side on the upper side, the airs W1 and W2 that have been warmed in the interior of the first control unit 51 and the second control unit 52 and have been moved in the upper direction can be efficiently exhausted from the air outlets 512*a* and 521*a*. The warmed airs W1 and W2 exhausted from the air outlets 512*a* and 521*a* are exhausted to the outside of the printing apparatus 1 from the opening 65 on the upper side of the air outlets 512*a* and 521*a*.

According to the medium heating device 7 of the present embodiment, each of the first control unit 51 and the second control unit 52 includes the heat sink 82 for heat dissipation including the plurality of fins 821. Since the plurality of fins 821 are formed along the flow of airs W1 and W2 flowing from the air inlet 511*a* to the air outlet 512*a* and from the air inlet 522*a* to the air outlet 521*a*, the heat of the heat sink 82 (fins 821) can be efficiently taken away, and thus the first control unit 51 and the second control unit 52 can be cooled.

According to the printing apparatus 1 of the embodiment, since the medium heating device 7 is provided, the first control unit 51 and the second control unit 52 can be appropriately cooled, and thus the heating unit 4 can be appropriately driven. As a result, the ink can be reliably dried and fixed, and thus the printing quality can be maintained.

Second Embodiment

Figure 5:
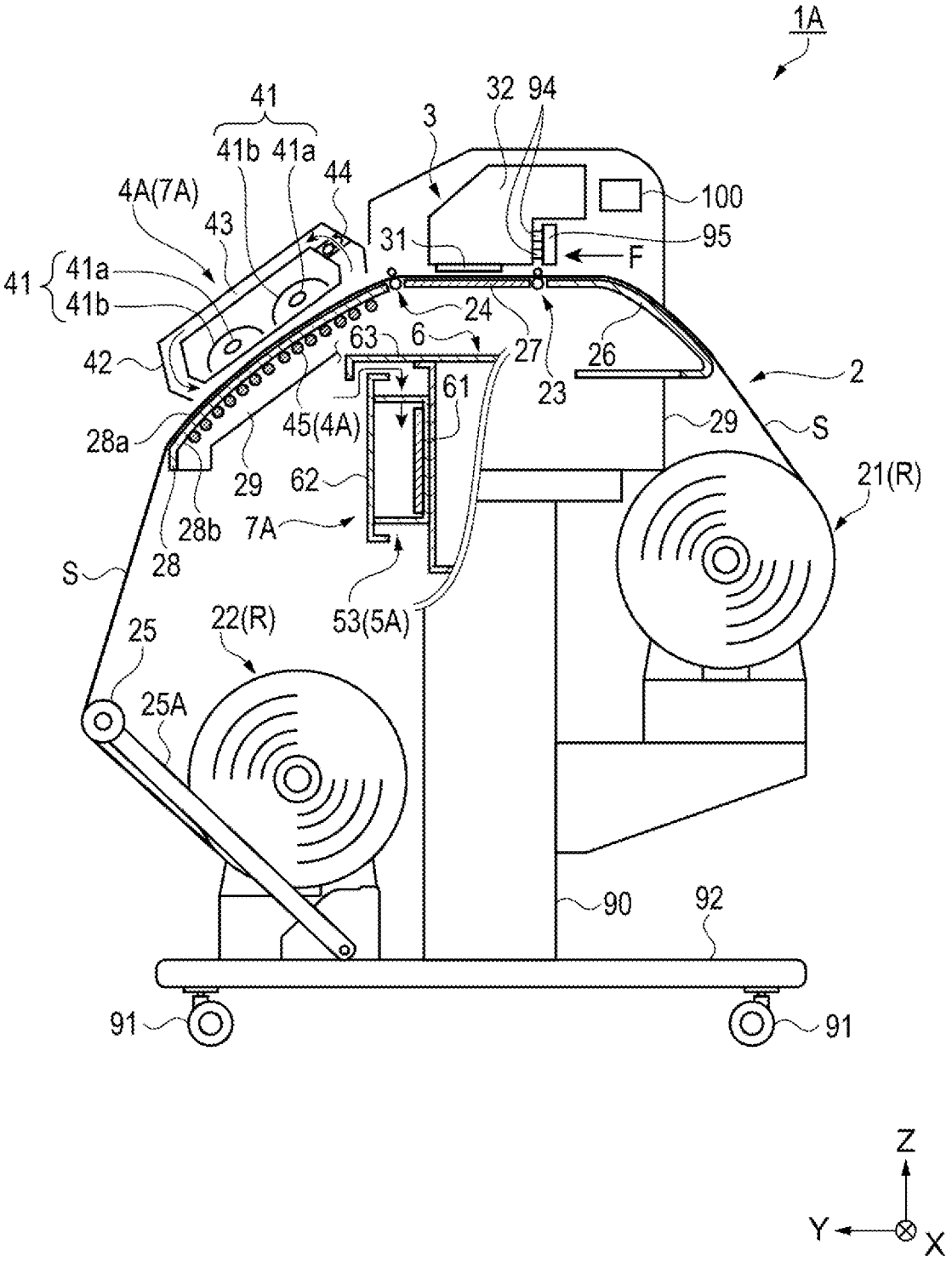
FIG. 5 is a schematic view illustrating a configuration of a printing apparatus according to a second embodiment.
Figure 6:
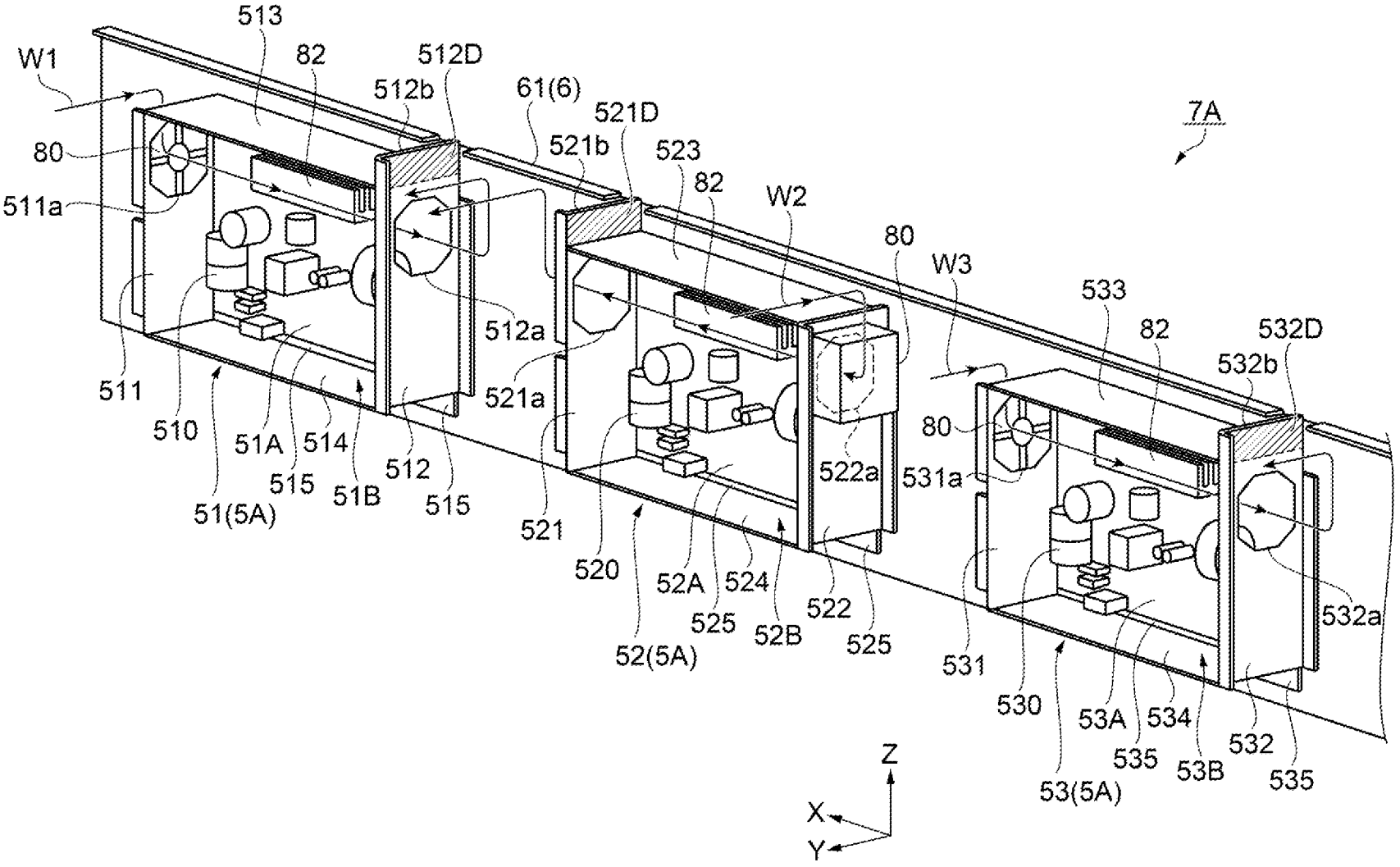
FIG. 6 is a schematic perspective view illustrating a heater control unit.

FIG. 5 is a schematic perspective view illustrating a configuration of a printing apparatus 1A according to a second embodiment. FIG. 6 is a schematic perspective view illustrating a heater control unit 5A.

As illustrated in FIG. 5, the printing apparatus 1A of the present embodiment differs from the printing apparatus 1 of the first embodiment in a medium heating device 7A. Specifically, the medium heating device 7A of the present embodiment includes, as a heating unit 4A, a second heater 45 in addition to the heating unit 4 of the first embodiment.

As illustrated in FIG. 5, the second heater 45 is composed of a so-called tube heater. In addition, the second heater 45 is configured in a state where it extends in the width direction X in a meandering manner. The second heater 45 with such a configuration is attached to a surface 28*b*, which is a surface of the third support member 28 on the opposite side to the support surface 28*a*, with an aluminum tape (not illustrated) therebetween.

In the present embodiment, the third support member 28 is formed of an aluminum flat plate as a metal member. The second heater 45 is attached to the surface 28*b* and heats the third support member 28 by thermal conduction. Further, the second heater 45 heats the third support member 28 so as to heat the support surface 28*a* and indirectly heat the sheet S supported by the support surface 28*a*.

Note that the medium heating device 7A includes, as the heater control unit 5A, a third control unit 53 as a third control unit that controls the driving of the second heater 45 in addition to the heater control unit 5 (the first control unit 51 and the second control unit 52) of the first embodiment. That is, the heater control unit 5A of the present embodiment is composed of the first control unit 51, the second control unit 52, and the third control unit 53.

Now a configuration of the third control unit 53 is described.

As illustrated in FIG. 6, the third control unit 53 has a configuration substantially similar to that of the first control unit 51 of the first embodiment. The third control unit 53 is disposed on the right side (−X side) of the second housing 52B and is fixed to the front face side of the base frame 61. As illustrated in FIG. 6, the third control unit 53 includes a third board 53A on which circuit elements 530 are mounted on a circuit wiring board, and a third housing 53B that houses the third board 53A therein.

The third housing 53B is configured in a box shape. The third housing 53B is composed of a left face cover 531, a right face cover 532, an upper face cover 533, a lower face cover 534, and a rear face cover 535. As faces of five orientations, the left face cover 531, the right face cover 532, the upper face cover 533, the lower face cover 534, and the rear face cover 535, each of which is formed by bending a plate-like metal member, are assembled together in a box shape. The third board 53A is fixed to the inner surface of the rear face cover 535.

In the third housing 53B, the rear face cover 535 is fixed to the front face side of the base frame 61 of the control unit fixing housing 6, and thus the third control unit 53 is fixed to the base frame 61. The front face side of the third housing 53B is covered with the front face cover 62 of the control unit fixing housing 6 as in the first embodiment. With this configuration, the third board 53A is closed in the six directions.

Note that, as illustrated in FIG. 6, an air inlet 531*a* as an octagonal opening is formed in an upper portion of the left face cover 531. The air intake fan 80 similar to that of the first embodiment is installed on the outer surface of the left face cover 531 so as to cover the air inlet 531*a*. In addition, as illustrated in FIG. 6, an air outlet 532*a* as an octagonal opening is formed in an upper portion of the right face cover 532. In the present embodiment, when the third housing 53B is assembled, the air inlet 531*a* and the air outlet 532*a* are located opposite each other.

The right face cover 532 is configured such that an end portion 532*b* on the upper side extends upward of the upper face cover 533. As in the first embodiment, when the top cover 63 of the control unit fixing housing 6 is fixed to the base frame 61 so as to cover the base frame 61 from the upper side in the same manner as in the first embodiment, the upper side of the third control unit 53 is also covered, and the end portion 532*b* substantially makes contact with the rear surface 63*a* of the top cover 63. Note that, in the right face cover 532, a region extending upward from the upper face cover 533 to the end portion 532*b* as indicated with the hatching in FIG. 6 is defined as a partition region 532D in the present embodiment.

As illustrated in FIG. 6, the third board 53A includes the heat sink 82 for heat dissipation. In addition, the heat sink 82 includes a plurality of fins 821. As illustrated in FIG. 6, the heat sink 82 is installed so as to be located between the air inlet 531*a* and the air outlet 532*a* located substantially opposite each other in the third housing 53B.

The plurality of fins 821 are disposed along a flow of air W3 flowing from the air inlet 531*a* to the air outlet 532*a*. Specifically, the fins 821 are disposed such that the direction along the side having a larger surface area is substantially aligned with the flow direction of the air W3 flowing from the air inlet 531*a* to the air outlet 532*a*.

As illustrated in FIG. 6, the second control unit 52 and the third control unit 53 disposed on the right side (−X side) of the second control unit 52 are disposed such that the air inlet 522*a* of the second control unit 52 and the air inlet 531*a* of the third control unit 53 face each other. Note that the first control unit 51 and the second control unit 52 are disposed such that the air outlet 512*a* of the first control unit 51 and the air outlet 521*a* of the second control unit 52 face each other as in the first embodiment.

Note that the opening 65 is formed in the same manner as in the first embodiment also when the third control unit 53 is fixed to the control unit fixing housing 6. In addition, the third control unit 53 has a configuration in which the air inlet 531*a* and the air outlet 532*a* are provided on the opening 65 side as in the first embodiment.

Here, since the operation of the first control unit 51 and the second control unit 52 that is performed when the air intake fan 80 is driven is the same as that of the first embodiment, the description thereof is omitted, and the drive of the third control unit 53 is described.

When the air intake fan 80 of the third control unit 53 is driven, the air W3 outside the printing apparatus 1 flows into the interior of the control unit fixing housing 6 from the opening 65 as indicated by the arrows in FIG. 6. Specifically, the air W3 enters from the region of the opening 65 near the air inlet 531*a*. Then, the entered air W3 is taken by the air intake fan 80 of the third control unit 53 and flows into the interior of the third housing 53B through the air inlet 531*a*.

The air W3 having entered the interior of the third housing 53B takes away the heat in the housing warmed by the operation of the third board 53A and flows along the surfaces of the plurality of fins 821 of the heat sink 82, thereby taking away the heat from the fins 821 while flowing toward the air outlet 532*a*. Then, the air W3 warmed by taking away the heat is exhausted to the outside of the third housing 53B through the air outlet 532*a* as indicated by the arrows in FIG. 6. In the present embodiment, the air W3 exhausted in the right direction, which is the −X direction, from the air outlet 532*a* is exhausted from the opening 65 to the outside of the printing apparatus 1A.

In the present embodiment, the internal space (in particular, the opening 65) of the control unit fixing housing 6 formed along the X direction is partitioned by the partition region 521D provided in the left face cover 521 of the second control unit 52 and the partition region 532D provided in the right face cover 532 of the third control unit 53. In other words, the partition region 532D partitions the space such that the air inlet 531*a* and the air outlet 532*a* do not communicate with each other at the opening 65. In addition, the partition region 521D partitions the space such that the air inlet 522*a* and the air outlet 521*a* do not communicate with each other at the opening 65. In the present embodiment, the left face cover 521 including the partition region 521D and the right face cover 532 including the partition region 532D function as partition plates. Note that the right face cover 512 of the first housing 51B also functions as a partition plate.

With the left face cover 521 and the right face cover 532 as partition plates, the airs W2 and W3 taken in from the air inlets 522*a* and 531*a* take the outside air from the opening 65 partitioned off by the left face cover 521 and the right face cover 532. With the left face cover 521 and the right face cover 532 as the partition plates, the airs W2 and W3 taken into the interior from the opening 65 prevent taking in of the airs W2 and W3 exhausted from the air outlets 521*a* and 532*a* as much as possible. Note that, as in the first embodiment, the right face cover 512 and the left face cover 521 as the partition plates provide similar effects.

The medium heating device 7A of the printing apparatus 1A according to the present embodiment can provide the following effects while achieving the effects of the first embodiment.

According to the medium heating device 7A of the present embodiment, when the third control unit 53 is provided in addition to the first control unit 51 and the second control unit 52, they are disposed such that the air outlet 512*a* of the first control unit 51 and the air outlet 521*a* of the second control unit 52 face each other, and that the air inlet 522*a* of the second control unit 52 and the air inlet 531*a* of the third control unit 53 face each other. With this configuration, it is possible to prevent the airs W1, W2 and W3 exhausted from the air outlets 512*a*, 521*a* and 532*a* from being taken in from the air inlets 511*a*, 522*a* and 531*a*.

According to the medium heating device 7A of the present embodiment, the right face cover 532 as a partition plate is provided such that the air inlet 531*a* and the air outlet 532*a* of the third housing 53B do not communicate with each other through the opening 65 inside the control unit fixing housing 6. As a result, the cooling air W3 taken in from the air inlet 531*a* and the warmed air W3 exhausted from the air outlet 532*a* can be separated from each other, and thus the taken air W3 and the exhaust air W3 can be prevented from being mixed together, and in this manner, the third control unit 53 can be efficiently cooled.

According to the printing apparatus 1A of the embodiment, with the medium heating device 7A, the third control unit 53 can also be appropriately cooled in addition to the first control unit 51 and the second control unit 52, and thus, the heating unit 4A can be appropriately driven. As a result, the ink can be reliably dried and fixed, and thus the printing quality can be maintained.

Third Embodiment

Figure 7:
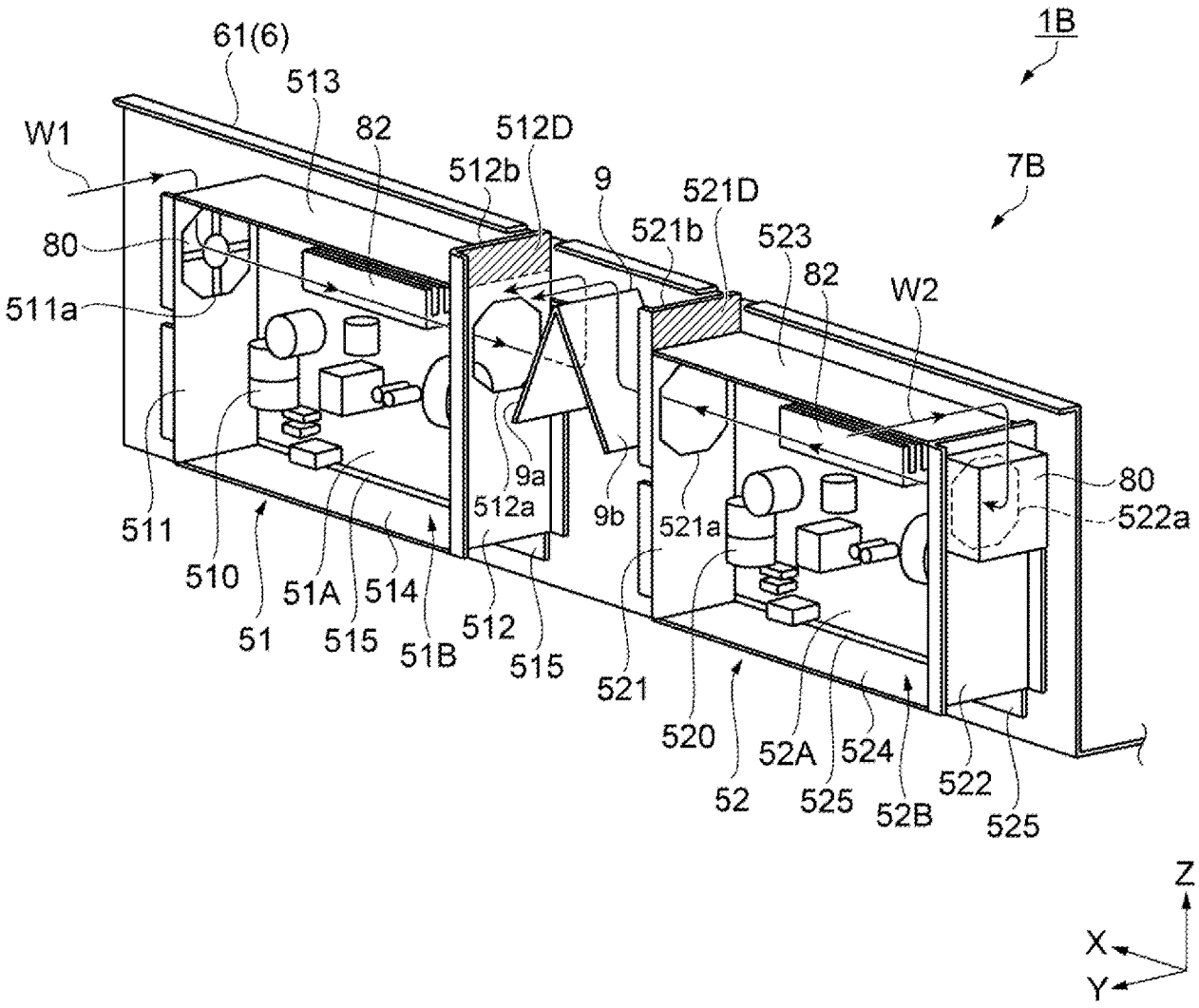
FIG. 7 is a schematic diagram illustrating a configuration of an airflow guiding part of a printing apparatus according to a third embodiment.

FIG. 7 is a schematic diagram illustrating a configuration of an airflow guiding part 9 of a printing apparatus 1B according to a third embodiment.

As illustrated in FIG. 7, the printing apparatus 1B of the embodiment differs from the printing apparatus 1 of the first embodiment in a medium heating device 7B. Specifically, the medium heating device 7B of the present embodiment includes the airflow guiding part 9 in the medium heating device 7 of the first embodiment.

Below, the airflow guiding part 9 is described, and the descriptions of the same components as those in the first embodiment are omitted.

As illustrated in FIG. 7, the airflow guiding part 9 is composed of a plate member that is bent at an acute angle so as to protrude upward. The airflow guiding part 9 is disposed between the air outlet 512*a* of the right face cover 512 in the first control unit 51 and the air outlet 521*a* of the left face cover 521 in the second control unit 52 which are disposed so as to face each other. The airflow guiding part 9 is fixed to the front face side of the base frame 61. The airflow guiding part 9 includes an inclined surface 9*a* that is inclined opposite the air outlet 512*a*, and an inclined surface 9*b* that is inclined opposite the air outlet 521*a*, and the airflow guiding part 9 has a function of guiding the exhaust.

When the airflow guiding part 9 is installed, the air W1 exhausted from the air outlet 512*a* of the first control unit 51 impinges on the inclined surface 9*a*, and thus the flow direction is changed to the direction of the opening 65 (upward direction), which is the intended direction. The air W2 exhausted from the air outlet 521*a* of the second control unit 52 impinges on the inclined surface 9*b*, and thus the flow direction is changed to the direction of the opening 65 (upward direction), which is the intended direction. The airs W1 and W2 whose flow directions have been changed to the upward direction by the airflow guiding part 9 are exhausted to the outside from the opening 65.

With the medium heating device 7B of the printing apparatus 1B according to the present embodiment, the following effects can be provided while achieving effects similar to the effects of the first embodiment.

According to the medium heating device 7B of the present embodiment, with the airflow guiding part 9 that guides the exhaust from the air outlet 512*a* of the first control unit 51 and the air outlet 521*a* of the second control unit 52 that face each other, the airs W1 and W2 exhausted from the air outlets 512*a* and 521*a* can be guided by the airflow guiding part 9 such that the flow directions thereof are appropriately changed to the direction of the opening 65 (intended direction). Accordingly, the exhaust airs W1 and W2 can be appropriately exhausted to the outside of the control unit fixing housing 6 (outside the printing apparatus 1B).

According to the printing apparatus 1B of the present embodiment, with the airflow guiding part 9 of the medium heating device 7B, the first control unit 51 and the second control unit 52 can be further appropriately cooled. As a result, the ink can be reliably dried and fixed, and thus the printing quality can be further maintained.

Note that, the present disclosure is not limited to the embodiments described above, and various modifications and improvements can be added to the above-described embodiments. Modifications are described below.

Modification 1

In the medium heating device 7 of the first embodiment, the first control unit 51 and the second control unit 52 include the air intake fan 80 at each of the air inlet 511*a* of the first control unit 51 and the air inlet 522*a* of the second control unit 52. However, the present disclosure is not limited to that configuration, and it suffices to include an air intake and exhaust fan having a function of taking or exhausting air at at least one of the air inlet 511*a* and the air outlet 512*a* of the first control unit 51, and at at least one of the air inlet 522*a* and the air outlet 521*a* of the second control unit 52. The same applies to the second embodiment.

Modification 2

While the three control units are provided in the medium heating device 7A of the second embodiment, four or more control units may be provided. In such a case, it suffices to sequentially dispose the control units such that the air outlets face each other and that the air inlets face each other, in the control units.

Modification 3

In the medium heating device 7A of the second embodiment, the right face cover 512 of the first control unit 51, the left face cover 521 of the second control unit 52, and the right face cover 532 of the third control unit 53 are configured as partition plates. However, the present disclosure is not limited to that configuration, and it suffices to appropriately set the configuration such that the air inlet and the air outlet do not communicate with each other inside the control unit fixing housing 6. The same applies to the first embodiment. The same also applies to the case in which four or more control units are provided.

Fourth Modification

Fine paper, cast-coated paper, art paper, coated paper, synthetic paper, or a film formed of polyethylene terephthalate (PET), polypropylene (PP), or the like may be used as the roll sheet S as a medium, for example.

Contents derived from the above-mentioned embodiments are described below.

A medium heating device includes a heating unit configured to heat a medium, a first control unit and a second control unit configured to control the heating unit, and a housing including the first control unit and the second control unit inside the housing. Each of the first control unit and the second control unit includes an air inlet and an air outlet, the first control unit and the second control unit include an air intake and exhaust fan installed at at least one of the air inlet and the air outlet of the first control unit, and at at least one of the air inlet and the air outlet of the second control unit, and the first control unit and the second control unit are disposed such that the air outlet of the first control unit and the air outlet of the second control unit face each other.

With this configuration, for example, when the air outlet and the air inlet of the first control unit and the second control unit that control the heating unit are installed in the same positional relationship, hot air exhausted from the air outlet of one control unit is taken in from the air inlet of the other control unit, and consequently the cooling efficiency of the other control unit is reduced. However, when the first control unit and the second control unit are disposed such that the air outlets thereof face each other, the air exhausted from the air outlets collide with each other, and it is thus possible to prevent their exhausts from affecting each other's cooling efficiencies. Accordingly, the first control unit and the second control unit can be efficiently cooled.

In the medium heating device, preferably, a partition plate is provided such that the air inlet and the air outlet do not communicate with each other inside the housing.

With this configuration, the air taken in from the air inlet and the air exhausted from the air outlet can be separated from each other. Thus, the taken air and the exhaust air can be prevented from being mixed together, and the first control unit and the second control unit can be efficiently cooled.

In the medium heating device, preferably, the first control unit and the second control unit include an airflow guiding part configured to guide exhaust from the air outlets that face each other.

With this configuration, the air exhausted from the air outlet can be guided to the airflow guiding part to change the flow direction to the intended direction. Accordingly, the flow direction of the exhaust air can be controlled, and thus, for example, the exhaust air can be appropriately exhausted to the outside of the housing by causing the exhaust to flow in the direction of the opening as an intended direction.

Preferably, the medium heating further includes a third control unit including an air inlet and an air outlet, the third control unit being configured to control the heating unit. The air outlet of the first control unit and the air outlet of the second control unit face each other, and the air inlet of the second control unit and the air inlet of the third control unit face each other.

With this configuration, in the case where the first control unit, the second control unit, and the third control unit are provided, air exhausted from the air outlet can be prevented from being taken in from the air inlet by disposing the air outlets and the air inlets such that the air outlets face each other and that the air inlets face each other.

In the medium heating device, preferably, the housing includes an opening located on an upper side of the first control unit and the second control unit, the opening being configured to communicate with outside along a direction in which the first control unit and the second control unit are disposed, and the first control unit and the second control unit include the air inlet and the air outlet on the opening side.

With this configuration, the air warmed inside the first control unit and the second control unit is easily moved in the upper direction in the interior. At this time, the opening provided in the housing on the upper side of the first control unit and the second control unit communicates with the outside along the direction in which the first control unit and the second control unit are disposed. Then, since the air inlets and the air outlets of the first control unit and the second control unit are disposed on the opening side, the air that has been warmed inside the first control unit and the second control unit and has been moved to the upper side can be efficiently exhausted from the air outlet. In addition, the warmed air exhausted from the air outlet is exhausted from the opening of the housing.

In the medium heating device, preferably, the first control unit and the second control unit include a heat sink for heat dissipation, the heat sink includes a plurality of fins, and the plurality of fins are formed along a flow of air flowing from the air inlet to the air outlet.

With this configuration, with the heat sink for heat dissipation that includes a plurality of fins formed along the flow of the air flowing from the air inlet to the air outlet, the heat of the heat sink can be efficiently taken away, and thus the first control unit, the second control unit, and the third control unit can be cooled.

A printing apparatus includes any of the above-mentioned medium heating devices.

With this configuration, with the medium heating device, the first control unit and the second control unit can be appropriately cooled and thus the heating unit can be appropriately driven. As a result, the ink can be reliably dried and fixed, and thus the printing quality can be maintained.

What is claimed is:

1. A medium heating device comprising:

a heating unit configured to heat a medium;

a first control unit, a second control unit configured to control the heating unit; and a housing including the first control unit and the second control unit inside the housing, wherein each of the first control unit and the second control unit includes an air inlet and an air outlet, the first control unit and the second control unit include an air intake and exhaust fan installed at at least one of the air inlet and the air outlet of the first control unit, and at at least one of the air inlet and the air outlet of the second control unit, and the first control unit and the second control unit are disposed such that the air outlet of the first control unit and the air outlet of the second control unit face each other, and the first control unit and the second control unit include a heat sink for heat dissipation, and at least a part of the heat sink is located inside an edge of the air outlet as viewed in a direction in which the first control unit and the second control unit are disposed side by side.

2. The medium heating device according to claim 1, wherein a partition plate is provided such that the air inlet and the air outlet do not communicate with each other inside the housing.

3. The medium heating device according to claim 1, wherein the first control unit and the second control unit include an airflow guiding part configured to guide exhaust from the air outlets that face each other.

4. The medium heating device according to claim 1, comprising a third control unit including an air inlet and an air outlet, the third control unit being configured to control the heating unit, wherein the air outlet of the first control unit and the air outlet of the second control unit face each other, and the air inlet of the second control unit and the air inlet of the third control unit face each other.

5. The medium heating device according to claim 1, wherein the housing includes an opening located on an upper side of the first control unit and the second control unit, the opening being configured to communicate with outside along a direction in which the first control unit and the second control unit are disposed, and the first control unit and the second control unit include the air inlet and the air outlet on the opening side.

6. The medium heating device according to claim 1, wherein the heat sink includes a plurality of fins, and the plurality of fins are formed along a flow of air flowing from the air inlet to the air outlet.

7. A printing apparatus comprising the medium heating device according to claim 1.

* * * * *